United States Patent [19]

Taylor, III

[11] 4,234,005

[45] Nov. 18, 1980

[54] COMBINATION PACK FRAME, COT, AND TENT

[76] Inventor: Edward L. Taylor, III, 6345 Kester Ave., Van Nuys, Calif. 90411

[21] Appl. No.: 966,890

[22] Filed: Dec. 6, 1978

[51] Int. Cl.[3] ..... A45F 3/10; A45F 4/02

[52] U.S. Cl. ..... 135/1 R; 5/113; 224/154; 224/156

[58] Field of Search ..... 135/1 R, 4 R; 5/113, 5/414, 416, 418; 224/9, 10, 25

[56] References Cited

U.S. PATENT DOCUMENTS

| | | | |
|---|---|---|---|
| 3,619,827 | 11/1971 | MacKenzie | 135/1 R X |
| 3,822,813 | 7/1974 | Carter | 135/1 R X |
| 3,918,109 | 11/1975 | Barraclough | 135/1 R X |
| 3,923,217 | 12/1975 | Dean | 135/1 R X |
| 3,971,495 | 7/1976 | Velazquez | 135/1 R X |
| 4,077,418 | 3/1978 | Cohen | 135/4 R |

FOREIGN PATENT DOCUMENTS

| | | | |
|---|---|---|---|
| 265737 | 10/1913 | Fed. Rep. of Germany | 5/113 |

*Primary Examiner*—J. Karl Bell

*Attorney, Agent, or Firm*—Poms, Smith, Lande & Rose

[57] ABSTRACT

A lightweight assembly weighing less than 10 pounds is provided for enabling a person who is living out of doors to sleep off the ground, and to have suitable shelter against the elements. The assembly is made up of two principal parts, the first being a pack frame which is to be secured to a person's back, and the second being the lightweight tubular folding structure which form the cot and the remainder of the tent support. The pack frame portion of the assembly is of generally A-frame configuration with a recessed frame to avoid contact with a person's back, and having two adjustable padded horizontal straps to engage the wearer's back. Additional frame members extend along the side and encompass the rear of the pack frame behind the actual pack per se, which may be of conventional configuration. The lower suspension points for the shoulder straps is underneath or to the rear of the center of gravity of the pack frame and pack assembly, and the resultant configuration reduces the pressure on the lower back of the user, as compared with conventional pack frame arrangements.

9 Claims, 5 Drawing Figures

COMBINATION PACK FRAME, COT, AND TENT

FIELD OF THE INVENTION

This invention relates to camping equipment, and more particularly to backpacks and sleeping and shelter equipment for persons whose vocation or avocation requires camping out of doors.

BACKGROUND OF THE INVENTION

For persons who sleep and live out of doors, the problem of the amount of gear which may be easily carried often forces persons to sleep on the ground and to be exposed to the elements. It is only in relatively accessible areas that cots and tents may normally be provided so that a person may sleep off the ground and have reasonable protection from the elements.

Accordingly, a principal object of the present invention is to provide lightweight equipment which may be readily packed into a remote location, and which will provide both shelter and a cot permitting sleeping in a protected area and off the ground.

SUMMARY OF THE INVENTION

In accordance with one broad aspect of the invention, a very lightweight foldable cot and tent frame is combined with a pack frame to provide a lightweight combination backpack cot, and tent. In accordance with particular features of the invention, the cot may be of very light tubular construction through the use of a large number, such as six or eight, supports which raise the main frame members of the cot up off the ground but do not require heavy, stress-supporting frame members.

In accordance with another feature of the invention, the pack frame member per se may be of generally A-frame configuration, which is open toward the lower center portion to avoid contact with the user's back, and is provided with side and rear frame members to enclose a conventional pack. The foldable cot is pivotally secured to the rear of the frame and folds up over the pack to complete the assembly for backpacking use.

One feature of the invention is the extension of the side of the frame forward of the area where it is supported on a person's back, and the use of a lower suspension point which is preferably underneath or toward the rear of the center of gravity of the backpack assembly. This last feature avoids undue pressure on the lower back of the user, and makes for much more comfortable support of the load. In addition, the pack is protected from damage by the enclosing frame.

In accordance with another feature of the invention, one or more adjustable, padded horizontal straps are provided to engage the wearer's back, and extend across the recess of the pack frame. This arrangement avoids chafing on the frame members and provides ventilation to evaporate perspiration.

Other objects, features, and advantages of the present invention will become apparent from a consideration of the following detailed description and from the accompanying drawings.

DETAILED DESCRIPTION

Figure 1:
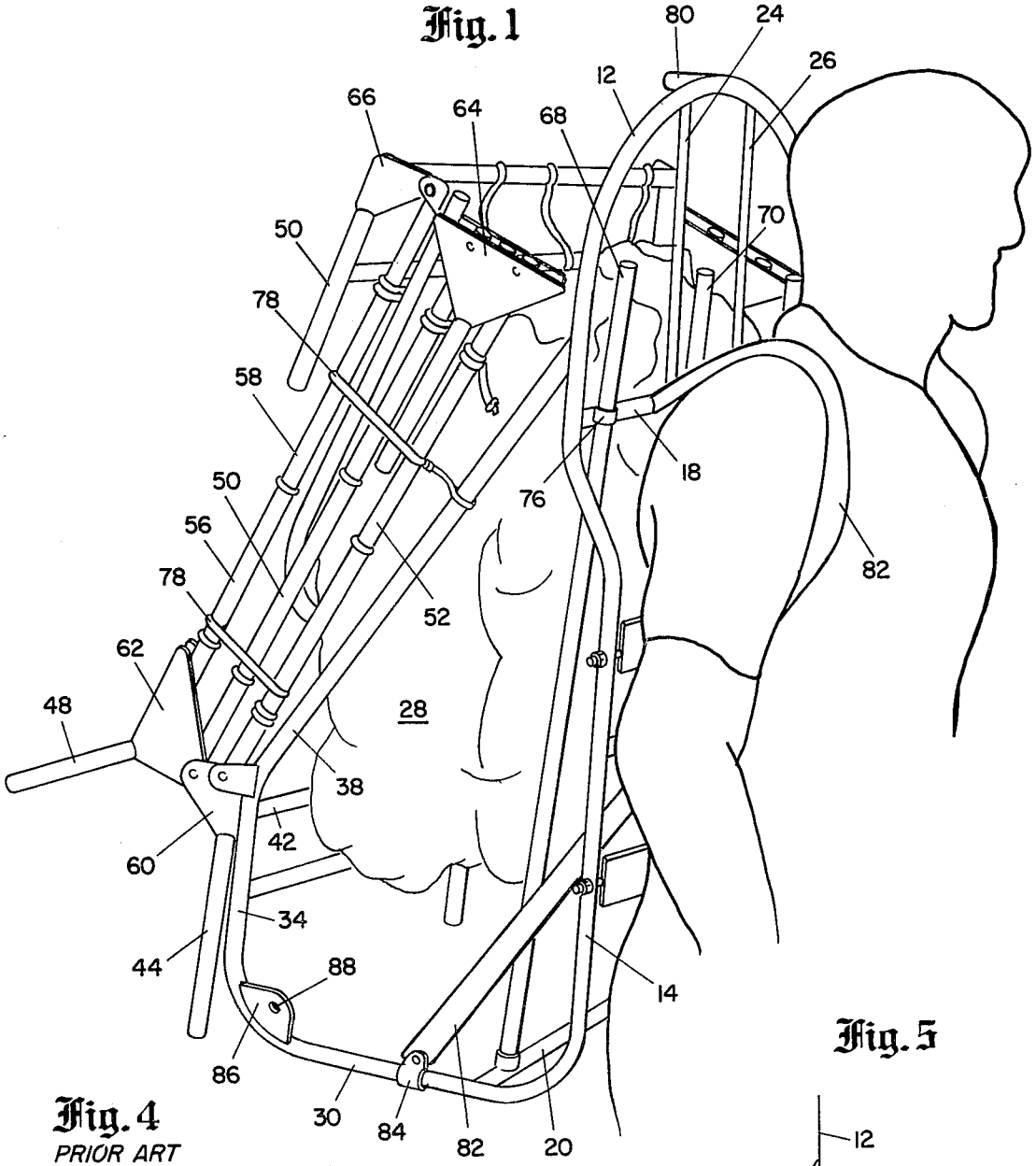
FIG. 1 shows a backpack assembly illustrating the principles of the invention as worn by a user.
Figure 2:
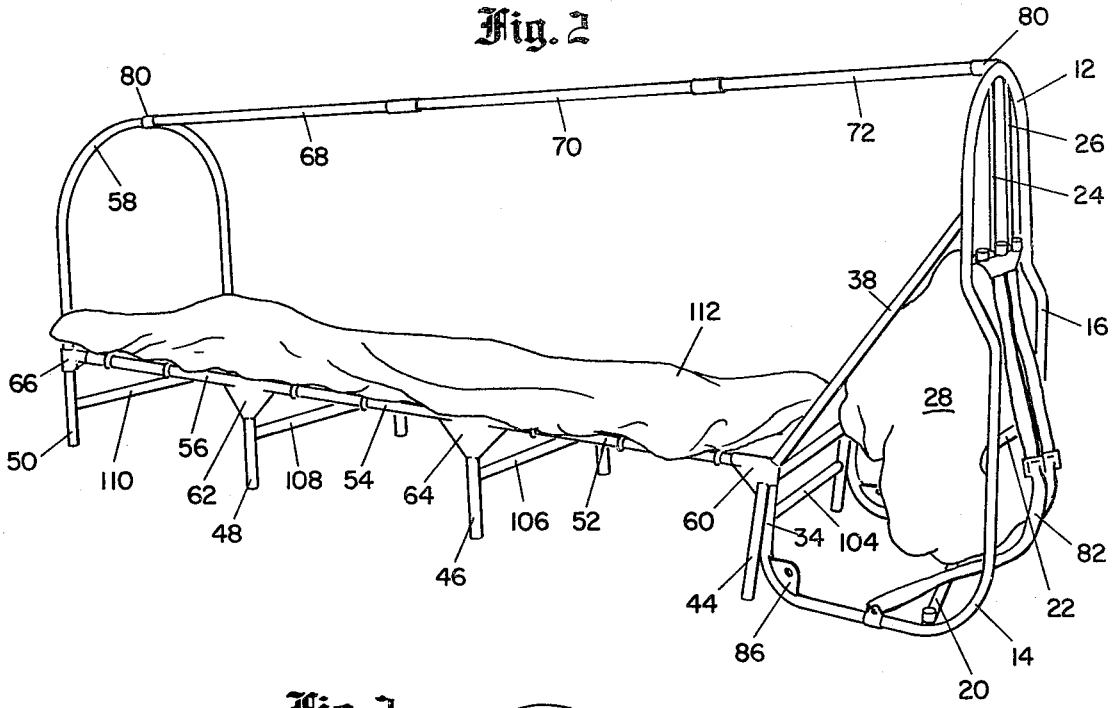
FIG. 2 shows the cot and tent frame unfolded and set up for sleeping.
Figure 3:
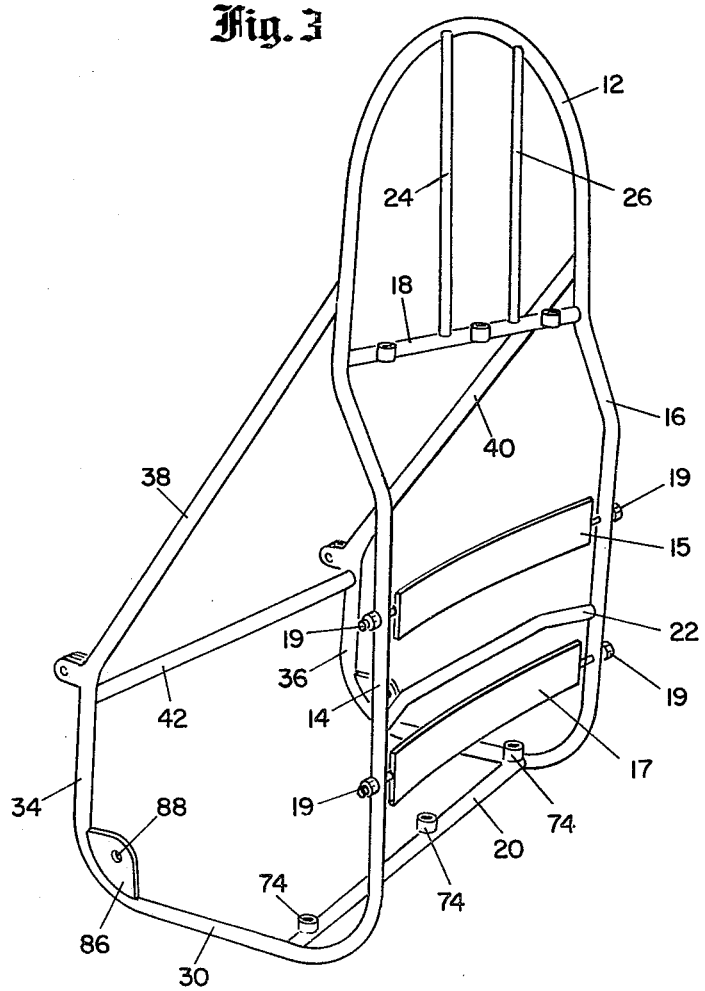
FIG. 3 is a view of the pack frame element with the backpack and other portions of the assembly removed therefrom.

Referring more particularly to the drawings, FIG. 1 shows the combination pack frame, cot, and tent frame of the present invention folded up and assembled for hiking. In the course of this initial description of the unit as shown in FIGS. 1, 2, and 3, it will be useful to note and compare the reference numerals in FIG. 2 with those of FIG. 1 to see clearly how the various frame members of the cot are folded up and form part of the members which are secured as part of the backpack. In addition, FIG. 3 shows the pack frame per se, with its transverse back engaging straps separate from all of the other elements which are attached to it, and the reference numerals shown in FIGS. 1 and 2 may be compared with the corresponding numbers in FIG. 3, and the corresponding parts may be identified.

First, concerning the pack frame per se, it may be noted that it is of generally A-frame configuration with a rounded top portion 12, two side members 14 and 16 which are spaced forward from the upper portion 12 by approximately 3 inches, upper and lower straight bracing members 18 and 20, and intermediate frame member 22 which is bent back slightly at each end adjacent the vertical supports 14 and 16, in order to avoid contact with the user's back. Two padded straps 15 and 17 are adjustably secured to vertical frame members 14 and 16 by fasteners 19. Tension may be adjusted by tightening or loosening the bolts 19. Thin vertical support members 24 and 26 extend between the transverse support member 18 and the curved upper member 12. Of course, the pack 28, which may be of conventional configuration, is protected by the frame.

The pack frame per se, as best shown in FIG. 3, also includes the rearwardly extending horizontal members 30 and 32, the short vertical rear portions of the frame 34 and 36, and the angled frame members 38 and 40, which join the vertical frame elements 34 and 36 with the curved upper section of the front portion of the frame 12. The protection of the pack 28 is completed by the horizontally extending member 42 at the rear of the basic pack frame element.

Attention will now be directed to the portion of the lightweight collapsible cot and tent frame, as shown in FIGS. 1 and 2. Referring first to FIG. 2, the four legs 44, 46, 48, and 50 may be seen in FIG. 1 alternately at the top and bottom of the pack frame assembly which overlies the angled frame members 38 and 40. Similarly, the three horizontal frame members 52, 54, and 56 are located parallel to one another in the assembled and folded-up arrangement as shown in FIG. 1. The rear A-frame member 58 forming part of the tent support structure is also shown in FIG. 1 between the two frame members 54 and 56. Similarly, the brackets 60 and 62 appear toward the lower end of the pack frame assembly, and the brackets 64 and 66 appear toward the top of the assembly of FIG. 1 as the unit is ready for backpacking. The ridge pole of the tent structure is made up of three sections 68, 70, and 72, and these are supported for carrying in receptacles 74 secured to the horizontal frame member 20. Similarly, loops 76 are secured to the upper horizontally extending frame member 18 for holding these members which eventually form the ridge pole of the tent structure.

Holes and pins in the various frame and bracket members hold the cot and tent frame in its assembled position as shown in FIG. 2. The extensible retaining members 78 hold the cot frame in its folded-up position against angled frame members 38 and 40 for backpacking. The two end A-frame supporting members 12 and 58 are provided with cylindrical recesses as shown at 80 at the top of the curved frame member facing to the rear. The tent ridge pole is formed by sliding the three sections 68, 70, and 72 into one another, and then engaging them into the cylindrical extensions 80 on the front and rear A-frame members.

The shoulder straps 82 are secured to the transverse member 18 to provide an upper suspension point, and to the lower transverse member 30 at point 84, or alternatively to the plate 86, which is provided with a securing opening 88, to provide a lower suspension point for the shoulder straps 82.

Figure 4:
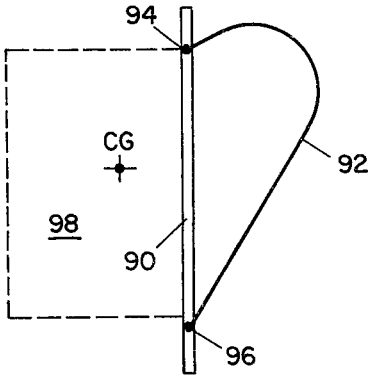
Fig. 4 PRIOR ART
FIGS. 4 and 5 are comparisons of a prior art pack frame and a pack frame illustrating the invention.
Figure 5:
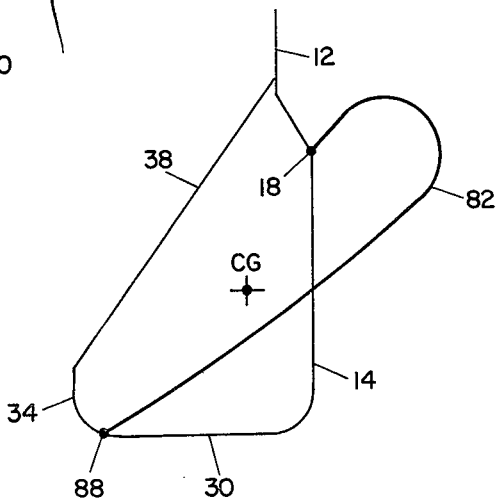

FIGS. 4 and 5 show a comparison between the supporting arrangements for a convention pack frame (FIG. 4), and the pack frame arrangement of the present invention, as shown in FIG. 5. With reference to FIG. 4, the tube frame is represented by member 90, and the shoulder strap is indicated by the reference numeral 92 with the upper and lower suspension points 94 and 96 indicating the points of attachment of the shoulder straps 92 to the frame 90. The center of gravity of the conventional pack is indicated at point 98. As can be appreciated, the arrangement as shown in FIG. 4 creates a very significant pressure in the vicinity of the lower suspension point 96, at the lower back area of the hiker.

FIG. 5 shows the arrangements of the present invention in which the shoulder straps 82 are mounted approximately at points indicated by the reference numerals 18 and 88. The center of gravity 102 is located approximately as shown in FIG. 5. It may be noted in the arrangement of FIG. 5 that the lower suspension point is generally below and preferably slightly to the rear of the center of gravity 102. This arrangement greatly reduces the torque, and eliminates the undesired heavy pressure on the lower back of the user; and the load hangs much more comfortably on the backpacker.

Incidentally, extending transversely between the vertically extending members 14 and 16 are adjustable back engaging straps or pads which permit proper adjustment of the load to suit the individual user.

Concerning materials which may be employed, the unit is preferably made of lightweight magnesium or aluminum; however, lightweight, high strength plastic tubing, such as fiberglass, could also be employed. One lightweight model which has been successfully tested had a complete frame which weighed less than 10 pounds, in the order of 8½ pounds. It is noted in passing that the use of several legs, such as four legs on each side in the indicated design reduces the strength and corresponding weight requirements for the horizontally extending sections of the cot so that they may be of reduced strength and of lighter weight material. In addition, the horizontally extending members 104, 106, 108 and 110, (see FIG. 2) are spaced downwardly from the side frame members, so that the sleeping bag 112 may be supported on rope or webbing extending between the two siderails of the cot, and the sleeper is not troubled by the impingement of the transverse frame members.

In conclusion, it is to be understood that the foregoing description is merely of one illustrative embodiment of the invention, and that minor modifications and changes may be made without departing from the spirit and scope thereof. For example, but not of limitation, the tent ridge pole could be dispensed with and a rope substituted therefore; alternative arrangements may be provided for pivoting the cot and A-frame members with respect to one another for easy folding and for maintaining in the proper positions, and different bracing arrangements may be provided for the basic pack frame structure of FIG. 3. Accordingly, the present invention is only to be limited by the scope of the appended claims.

What is claimed is:

1. A lightweight combination pack frame, cot, and tent comprising:

a tubular A-frame having an open central area having a size approximating a person's back, said A-frame including a lower portion for engaging the ground, and an upper portion for supporting a tent;

a cloth pack for containing conventional back packing equipment, and including means for engaging said tubular A-frame to support said pack in said open central area;

shoulder strap means for supporting said pack and A-frame on the wearer's back;

frame means extending to the rear substantially perpendicular to said A-frame and firmly secured to said A-frame for supporting said A-frame in the upright orientation when it is placed on the ground, and for enclosing said pack;

additional tubular frame means foldably secured to said rearwardly extending frame means for forming a cot when unfolded and for assembly into firm juxtaposition with said A-frame and said rearwardly extending frame means, when folded forward; and said cot having a much lower elevation than the height of said A-frame, whereby the A-frame provides a tent support to give protection from the elements to a person on said cot, while concurrently permitting access to said pack to the person on said cot.

2. A combination pack frame, cot and tent as defined in claim 1 further comprising:

means for forming a tent supporting frame engaging the top of said A-frame and extending over said cot.

3. A combination pack frame, cot and tent as defined in claim 2 wherein said tent supporting frame includes a second tubular A-frame located at the opposite end of said cot from said tubular A-frame.

4. A combination pack frame, cot and tent as defined in claim 1 further comprising:

means for providing upper and lower suspension points for said shoulder strap means, with the lower suspension point being located below and slightly to the rear of the center of gravity of said backpack assembly.

5. A lightweight combination pack frame, cot and tent as defined in claim 1 further comprising at least one padded horizontal strap means extending across said open central area for engaging the wearer's back.

6. A pack frame arrangement comprising:

a front frame arrangement including an open lower space for receiving the wearer's back;

rearwardly extending frame members secured to said front frame arrangement for enclosing and protecting a conventional pack;

shoulder strap means for supporting said back pack assembly;

means for providing upper and lower suspension points for said shoulder strap means, with the lower suspension point being located below and slightly to the rear of the center of gravity of said backpack assembly;

foldable cot frame means mounted near the bottom of said rearwardly extending frame means for forming a cot in an unfolded configuration and for folding onto the rear of said rearwardly exterding frame members in the folded configuration; and means for supporting a tent to enclose said cot and said pack, secured to said front frame arrangement; whereby a user may be protected from the elements and concurrently have access to said pack from said cot.

7. A pack frame arrangement as defined in claim 6 further comprising at least one padded horizontal strap means extending across said open central area for engaging the wearer's back.

8. A combination pack frame and cot as defined in claim 6 further comprising means for mounting a pack, said cot, and all of the components of said tent on said pack frame in a compact arrangement, for use in rough hostile terrain.

9. A combination pack frame and cot as defined in claim 6 wherein said additional frame means for forming a cot includes at least six supports for engaging the ground, and transverse frame members interconnecting said supports intermediate the length thereof, the total weight of said pack frame and said additional frame being less than ten pounds.

* * * * *